US011289292B2

(12) United States Patent
Baron et al.

(10) Patent No.: US 11,289,292 B2
(45) Date of Patent: Mar. 29, 2022

(54) OVERPRESSURE-RESISTANT VACUUM INTERRUPTER TUBE

(71) Applicant: SIEMENS AKTIENGESELLSCHAFT, Munich (DE)

(72) Inventors: Lydia Baron, Dallgow-Doeberitz (DE); Frank Graskowski, Wandlitz (DE); Andreas Lawall, Berlin (DE); Christian Stiehler, Berlin (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 16/771,806

(22) PCT Filed: Nov. 20, 2018

(86) PCT No.: PCT/EP2018/081919
§ 371 (c)(1),
(2) Date: Jun. 11, 2020

(87) PCT Pub. No.: WO2019/115175
PCT Pub. Date: Jun. 20, 2019

(65) Prior Publication Data

US 2021/0074493 A1 Mar. 11, 2021

(30) Foreign Application Priority Data

Dec. 11, 2017 (DE) ..... 102017222413

(51) Int. Cl.
*H01H 33/662* (2006.01)
*H01H 33/664* (2006.01)

(52) U.S. Cl.
CPC .... *H01H 33/66207* (2013.01); *H01H 33/664* (2013.01); *H01H 2033/6623* (2013.01)

(58) Field of Classification Search
CPC ..... H01H 33/66207; H01H 33/664; H01H 2033/66246; H01H 2033/66253; H01H 2033/6623
(Continued)

(56) References Cited

U.S. PATENT DOCUMENTS 4,071,727 A * 1/1978 Crouch ..... H01H 33/66238 200/83 D
4,445,016 A * 4/1984 Sinnecker ..... H01H 33/66207 174/50.57
(Continued)

FOREIGN PATENT DOCUMENTS

CN 102456504 A 5/2012
CN 203931925 U 11/2014
(Continued)

*Primary Examiner* — William A Bolton
(74) *Attorney, Agent, or Firm* — Laurence A. Greenberg; Werner H. Stemer; Ralph E. Locher

(57) ABSTRACT

A vacuum interrupter tube contains at least one insulating body, a fixed contact, a fixed contact flange, a moving contact having a longitudinal axis, a moving contact flange, and a bellows. The fixed contact is stationarily arranged in the fixed contact flange. The moving contact is moveably guided and the moving contact is moveably secured to the moving contact flange by the bellows. The bellows is secured to the moving contact flange by a first bellows end and the bellows is secured to the moving contact by a second bellows end. Therein the vacuum interrupter tube is protected against the deformation of at least one of the fixed contact flange and the moving contact flange due to an ambient pressure of the vacuum interrupter tube of over two bar by a stiffened fixed contact flange and/or a stiffened moving contact flange.

9 Claims, 3 Drawing Sheets

(58) Field of Classification Search
USPC ..... 218/118, 123, 124, 127, 134, 135, 139
See application file for complete search history.

(56) References Cited

U.S. PATENT DOCUMENTS

| | | | | |
|---|---|---|---|---|
| 4,482,790 | A | 11/1984 | Miyagawa et al. | |
| 4,933,518 | A * | 6/1990 | Yin | H01H 33/66207 218/134 |
| 4,962,289 | A * | 10/1990 | Stegmuller | H01H 33/66238 218/134 |
| 5,168,139 | A * | 12/1992 | Bettge | H01H 33/664 218/135 |
| 5,313,030 | A * | 5/1994 | Kusserow | H01H 33/66207 218/136 |
| 6,308,857 | B1 | 10/2001 | Heimbach et al. | |
| 7,781,694 | B2 * | 8/2010 | Stoving | H01H 33/6645 218/136 |
| 9,190,232 | B2 * | 11/2015 | Abe | H02B 13/0655 |
| 2009/0218318 | A1 | 9/2009 | Gentsch | |

FOREIGN PATENT DOCUMENTS

| | | | |
|---|---|---|---|
| CN | 107342185 | A | 11/2017 |
| DE | 10007907 | A1 | 12/2000 |

* cited by examiner

OVERPRESSURE-RESISTANT VACUUM INTERRUPTER TUBE

BACKGROUND OF THE INVENTION

Field of the Invention

The invention relates to an overpressure-resistant vacuum interrupter tube for medium-voltage switchgear assemblies and high-voltage switchgear assemblies, and to a switchgear assembly comprising such an overpressure-resistant vacuum interrupter tube.

Vacuum interrupter tubes from the prior art are not suitable for operation under a high ambient pressure. High ambient pressures of more than one bar (1 bar), in particular more than two bar (2 bar) lead in particular to deformations at the fixed contact flange and/or the moving contact flange. Said deformations impair the operation of the vacuum interrupter tube and may also lead to destruction of the vacuum interrupter tube.

Summary of the Invention

It is now the object of the invention to provide an overpressure-resistant vacuum interrupter tube which reduces or prevents deformations of the fixed contact flange and/or of the moving contact flange.

The object is achieved by the independent claim and the claims that are dependent thereon.

In one exemplary embodiment, the vacuum interrupter tube has at least one insulating body, a fixed contact, a fixed contact flange, a moving contact having a longitudinal axis of the moving contact, a moving contact flange, and a bellows, wherein the fixed contact is arranged in a positionally fixed manner in the fixed contact flange, the moving contact is movably guided and the moving contact is movably secured to the moving contact flange by the bellows, wherein the bellows is secured to the moving contact flange by a first bellows end and the bellows is secured to the moving contact by a second bellows end, wherein the vacuum interrupter tube is protected against deformations of at least one of the fixed contact flange and the moving contact flange by an ambient pressure of the vacuum interrupter tube of over two bar (2 bar), by means of a stiffened fixed contact flange and/or moving contact flange.

An ambient pressure of more than 2 bar occurs in particular when a vacuum interrupter tube is arranged in a gas-insulated container having an insulating gas and the gas pressure in the gas-insulated container is more than 2 bar. Alternatively, the vacuum interrupter tube may, however, also be arranged in a fluid, in particular an insulating fluid, and the ambient pressure may be more than 2 bar. The vacuum interrupter tube may also be acted upon by a solid, in particular solid insulation, with a pressure of 2 bar. The ambient pressure describes the pressure acting on the outer side of the vacuum interrupter tube.

It is preferred that the stiffened fixed contact flange and/or the stiffened moving contact flange are/is stiffened by a respective structural element, which is assigned to the respective fixed contact flange or respective moving contact flange, which at least partially reproduces the shape of the stiffened fixed contact flange and/or of the stiffened moving contact flange that is oriented into the interior of the vacuum interrupter tube.

The structural element here increases the stability of the respective stiffened fixed contact flange and/or of the stiffened moving contact flange without more greatly mechanically loading the transition between the insulating element and the stiffened fixed contact flange and/or the stiffened moving contact flange.

It is also preferred that the structural element has a first region and a second region, wherein the first region extends substantially perpendicularly to the longitudinal axis of the moving contact and the second region extends substantially parallel to the longitudinal axis of the moving contact, wherein the first region substantially reproduces the shape of the stiffened fixed contact flange and/or of the stiffened moving contact flange that is oriented into the interior of the vacuum interrupter tube and the second region substantially supports the first region.

Furthermore, it is preferred that a shielding element is arranged between the fixed contact flange and the insulating element or on the fixed contact flange.

It is also preferred that the second region of the structural element supports the first region of the structural element against the insulating element or against the insulating element via the shielding element or against a third region of the fixed contact flange and the first region thus protects the fixed contact flange against deformations.

It is also preferred that the structural element or the structural elements is or are not soldered to the vacuum interrupter tube or to components of the vacuum interrupter tube. This prevents mechanical stresses from being induced in the connection, in particular soldered joint, between insulating element and stiffened fixed contact flange and/or the stiffened moving contact flange.

It is also preferred that the stiffened fixed contact flange and/or the stiffened moving contact flange are/is stiffened by a heavier, thicker design of the stiffened fixed contact flange and/or of the stiffened moving contact flange, wherein the stiffened fixed contact flange and/or stiffened moving contact flange are/is formed from a material which has a coefficient of expansion which is similar to the coefficient of expansion of the insulating body. In particular, similar is intended to mean a deviation of less than 10% from the coefficient of expansion of the material of the stiffened fixed contact flange and/or the stiffened moving contact flange and from the coefficient of expansion of the insulating body, particular preferably of less than 5%.

Furthermore, it is preferred that the insulating body is formed from a ceramic, and that the stiffened fixed contact flange and/or the stiffened moving contact flange contains an FeNiCo alloy or is formed therefrom.

A further exemplary embodiment relates to a switchgear assembly comprising a vacuum interrupter tube according to one or more of the above embodiments for medium-voltage applications or high-voltage applications, wherein the vacuum interrupter tube is arranged in a gas-tight container which is filled with an insulating gas and the insulating gas in the gas-tight container has a pressure of at least 2 bar, preferably of more than 3 bar.

It is preferred that the insulating gas comprises one or more of fluoroketones, nitriles, nitrogen, oxygen and carbon dioxide.

It is particularly preferred that the insulating gas contains nitrogen and carbon dioxide or a fluoroketone and nitrogen or a fluoroketone and oxygen or a fluoroketone and carbon dioxide. In particular, it is preferred that 80% of the insulating gas is composed of nitrogen and 20% of carbon dioxide. The percentages relate to percent by mass or percent by volume.

The invention will be explained below with reference to figures.

DETAILED DESCRIPTION OF THE INVENTION

Figure 1:
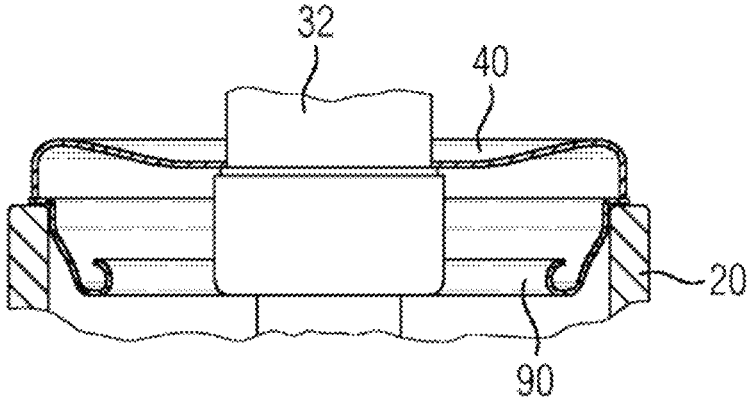
FIG. 1: section through the region of the fixed contact flange of a conventional vacuum interrupter tube

FIG. 1 shows a section through the region of the fixed contact flange 40 of a conventional vacuum interrupter tube. The fixed contact rod 32 is connected to the fixed contact flange 40 and guided in this manner into the interior of a vacuum interrupter tube. The fixed contact flange 40 is in turn secured to an insulating part 20 of the vacuum interrupter tube. In the example shown, a shielding element 90 is secured between the fixed contact flange 40 and the insulating part 20. Alternatively, the shielding element 90 may also be secured to the fixed contact flange 40 and the fixed contact flange 40 may be secured directly to the insulating part 20.

A heavier design of the fixed contact flange 40, i.e. a design in which the material strength and material thickness has been increased, would lead in the region where the fixed contact flange 40 is connected directly or via a shielding element to the insulating element, to heavy mechanical loads and would thus prevent permanent operability of the vacuum interrupter tube.

Figure 2:
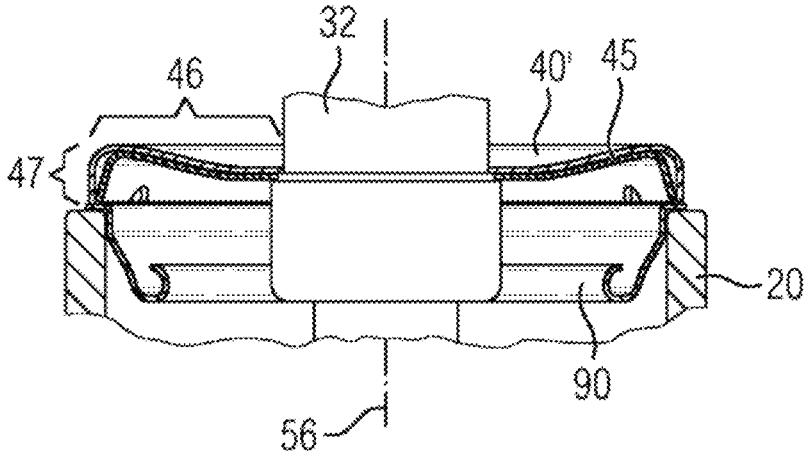
FIG. 2: section through region of the fixed contact flange of a vacuum interrupter tube according to the invention with a stiffened fixed contact flange

FIG. 2 shows a section through the region of the fixed contact flange 40' of a vacuum interrupter tube according to the invention with a stiffened fixed contact flange 40'. The fixed contact rod 32 is again connected to the fixed contact flange 40' and is guided in this manner into the interior of a vacuum interrupter tube according to the invention. The fixed contact flange 40' is in turn secured to an insulating part 20 of the vacuum interrupter tube. In the example shown, a shielding element 90 is secured between the fixed contact flange 40' and the insulating part 20. Alternatively, the shielding element 90 can also be secured to the fixed contact flange 40' and the fixed contact flange 40' can be secured directly to the insulating part 20.

In the example of FIG. 2, the fixed contact flange 40' is stiffened by the structural element 45. The structural element 45 in a first region 46, which is oriented substantially perpendicularly to the longitudinal axis 56 of the fixed contact 30, substantially reproduces the shape of the fixed contact flange 40' that is directed into the interior of the vacuum interrupter tube and, in this case, even lies against the fixed contact flange 40'. In a second region 47 of the structural element 45 that is oriented substantially parallel to the longitudinal axis 56 of the fixed contact 30, the second region 47 supports the first region 46 against the fixed contact flange 40'. Alternatively, the second region 47 of the structural element 45 can also support the first region 46 of the structural element 45 against the insulating element 20 and/or the shielding element 90.

Figure 3:
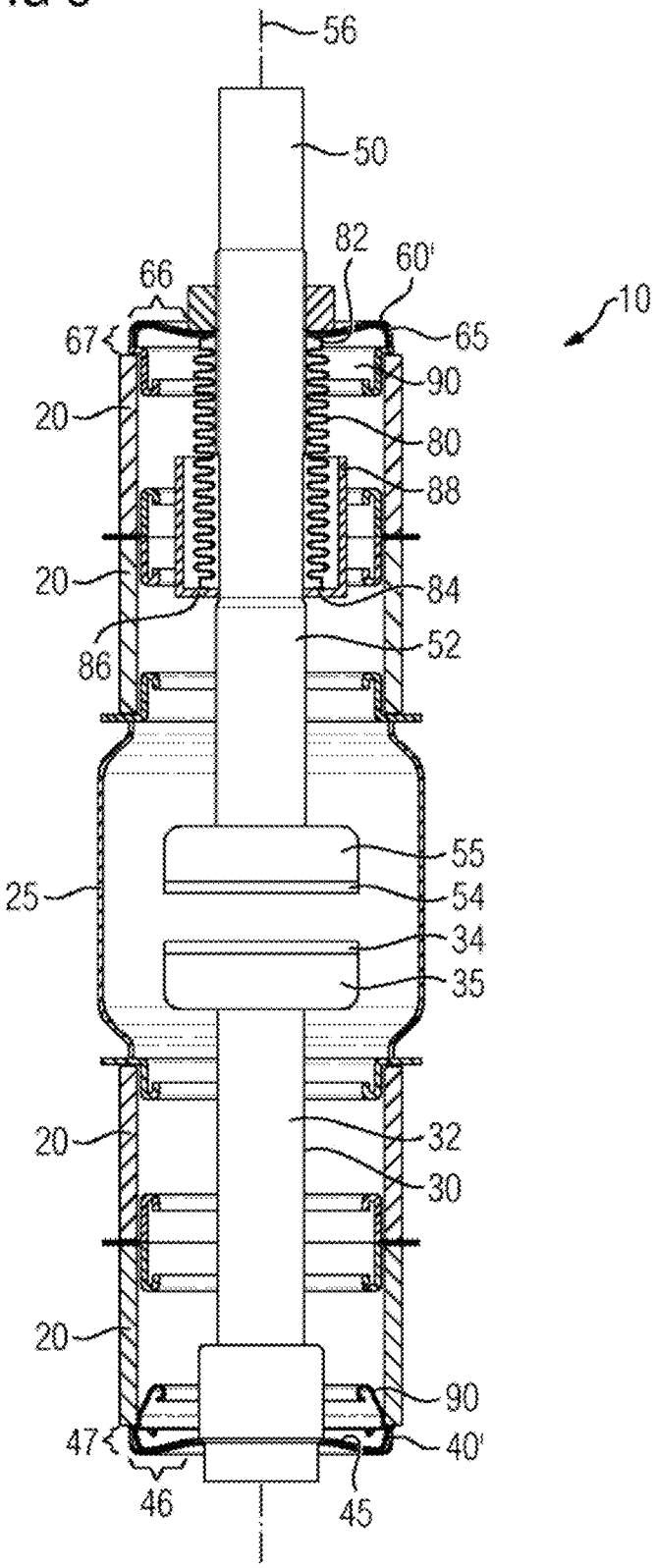
FIG. 3: section through a vacuum interrupter tube with a stiffened fixed contact flange and stiffened moving contact flange according to the invention.

FIG. 3 shows a section through a vacuum interrupter tube 10 with a stiffened fixed contact flange 40' and stiffened moving contact flange 60' according to the invention. In this exemplary embodiment, the vacuum interrupter tube 10 has four insulating elements 20, with an intermediate element 25 which can be composed of an electrically conductive or electrically non-conductive material being arranged between two insulating elements 20.

The moving contact 50 is movably guided into the vacuum interrupter tube 10 by means of a bellows 80, wherein a first bellows end 82 is secured to the stiffened moving contact flange 60' and a second bellows end 84 is secured to the moving contact rod 52, either directly or via a bellows cap 86. In addition, the bellows cap has an optional bellows shield 88.

The moving contact flange 60' is connected to an insulating element 20 of the vacuum interrupter tube 10 directly or via a shielding element 90.

The moving contact flange 60' is stiffened by the structural element 65. The structural element 65 has a first region 66 which is oriented substantially perpendicularly to the longitudinal axis 56 of the moving contact 50, substantially reproduces the shape of the moving contact flange 60' that is directed into the interior of the vacuum interrupter tube and, in this case, even lies against the moving contact flange 60'. In a second region 67 of the structural element 65 that is oriented substantially parallel to the longitudinal axis 56 of the moving contact 50, the second regions 67 supports the first region 66 against the moving contact flange 60'. Alternatively, the second region 67 of the structural element 65 can also support the first region 66 of the structural element 65 against the insulating element 20 and/or the shielding element 90.

In the exemplary embodiment, the moving contact 50 consists of a moving contact rod 53, a moving contact body 55 and a moving contact contact disk 54.

The fixed contact 30 is formed here by a fixed contact rod 32, a fixed contact body 35 and a fixed contact contact disk 34 and is connected to the fixed contact flange 40' and is guided in this way into the interior of a vacuum interrupter tube 10 according to the invention. The fixed contact flange 40' is in turn secured to an insulating part 20 of the vacuum interrupter tube. In the example shown, a shielding element 90 is secured between the fixed contact flange 40' and the insulating part 20. Alternatively, the shielding element 90 can also be secured to the fixed contact flange 40' and the fixed contact flange 40' can be secured directly to the insulating part 20.

In the example of FIG. 3, the fixed contact flange 40' is stiffened by the structural element 45. The structural element 45 in a first region 46, which is oriented substantially perpendicularly to the longitudinal axis 56 of the fixed contact 30, substantially reproduces the shape of the fixed contact flange 40' that is directed into the interior of the vacuum interrupter tube and, in this case, even lies against the fixed contact flange 40'. In a second region 47 of the structural element 45 that is oriented substantially parallel to the longitudinal axis 56 of the fixed contact 30, the second region 47 supports the first region 46 against the fixed contact flange 40'. Alternatively, the second region 47 of the structural element 45 can also support the first region 46 of the structural element 45 against the insulating element 20 and/or the shielding element 90.

Figure 4:
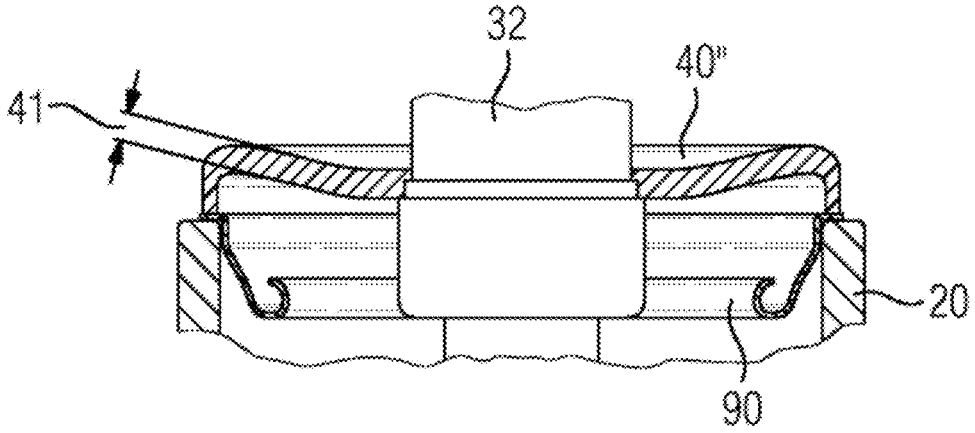
FIG. 4: section through region of the fixed contact flange of a vacuum interrupter tube according to the invention with a stiffened contact flange

FIG. 4 shows a section through region of the fixed contact flange 40" of a vacuum interrupter tube according to the invention with a stiffened fixed contact flange 40".

The fixed contact rod 32 is connected to the fixed contact flange 40" and is guided in this way into the interior of a vacuum interrupter tube according to the invention. The fixed contact flange 40" is secured to an insulating part 20 of the vacuum interrupter tube. In the example shown, a shielding element 90 is secured between the fixed contact flange 40" and the insulating part 20. Alternatively, the shielding element 90 can also be secured to the fixed contact flange 40' and the fixed contact flange 40" can be secured directly to the insulating part 20.

In the example of FIG. 4, the fixed contact flange 40" is stiffened by the fact that a heavier design, i.e. thicker in terms of material, of the stiffened fixed contact flange 40" is used, wherein the stiffened fixed contact flange 40" is formed from a material which has a coefficient of expansion which is similar to the coefficient of expansion of the insulating body 20.

Heavier or thicker material, heavier or thicker design of the material is intended to mean in this connection that the fixed contact flange 40" has a greater material thickness 41.

LIST OF REFERENCE SIGNS

10 Vacuum interrupter tube
20 Insulating body
25 Intermediate element
30 Fixed contact
32 Fixed contact rod
34 Fixed contact contact disk
35 Fixed contact body
40, 40', 40" Fixed contact flange
42 Material thickness of the fixed contact flange 40"
45 Structural element
46 First region of the structural element 45
47 Second region of the structural element 45
50 Moving contact
52 Moving contact rod
54 Moving contact contact disk
55 Moving contact body
56 Longitudinal axis of the moving contact and fixed contact
60, 60' Moving contact flange
65 Structural element
66 First region of the structural element 65
67 Second region of the structural element 65
70 Moving contact bearing
80 Bellows
82 First bellows end
84 Second bellows end
86 Bellows cap
88 Bellows shield
90 Shielding element

The invention claimed is:

1. A vacuum interrupter tube, comprising:

at least one insulating body;

a fixed contact;

a fixed contact flange, said fixed contact is disposed in a positionally fixed manner in said fixed contact flange;

a moving contact having a longitudinal axis;

a moving contact flange;

a bellows having a first bellows end and a second bellows end;

said moving contact being movably guided and said moving contact being movably secured to said moving contact flange by said bellows, said bellows secured to said moving contact flange by said first bellows end and said bellows is secured to said moving contact by said second bellows end;

a fixed contact flange stiffener, said fixed contact flange and said fixed contact flange stiffener being formed as a one-piece configuration defining a heavier fixed contact flange;

a moving contact flange stiffener, said moving contact flange and said moving contact flange stiffener being formed as a one-piece configuration defining a heavier moving contact flange;

said fixed contact flange stiffener or said moving contact flange stiffener being a structural element which only partially reproduces a shape of said fixed contact flange and/or of said moving contact flange that is oriented into an interior of the vacuum interrupter tube;

said structural element having a first region and a second region said second region of said structural element supporting said first region of said structural element against said insulating body;

at least one of said heavier fixed contact flange or said heavier moving contact flange being formed from a material having a coefficient of expansion being a same as a coefficient of expansion of said insulating body; and the vacuum interrupter tube being protected against deformation of at least one of said fixed contact flange and said moving contact flange by an ambient pressure of the vacuum interrupter tube of over two bar, by means of said fixed contact flange stiffener and/or said moving contact flange stiffener.

2. The vacuum interrupter tube according to claim 1, wherein said first region extends substantially perpendicularly to the longitudinal axis of said moving contact and said second region extends substantially parallel to the longitudinal axis of said moving contact, wherein said first region substantially reproduces a shape of said fixed contact flange and/or of said moving contact flange that is oriented into the interior of the vacuum interrupter tube and said second region substantially supports said first region.

3. The vacuum interrupter tube according to claim 2, further comprising a shielding disposed between said fixed contact flange and/or said moving contact flange and said insulating body or on said fixed contact flange and/or said moving contact flange.

4. The vacuum interrupter tube according to claim 3, wherein said second region of said structural element supports said first region of said structural element against said insulating body via said shielding; and said first region protects said fixed contact flange and/or said moving contact flange against deformation.

5. The vacuum interrupter tube according to claim 1, wherein said structural element or said structural elements is or are not soldered to the vacuum interrupter tube or to other components of the vacuum interrupter tube.

6. The vacuum interrupter tube according to claim 1, wherein said insulating body is formed from a ceramic, and in that said heavier fixed contact flange and/or said heavier moving contact flange contains an FeNiCo alloy or is formed therefrom.

7. A switchgear assembly, comprising:

the vacuum interrupter tube according to claim 1 for media voltage applications or high-voltage applications;

a gas-tight container filled with an insulating gas, said vacuum interrupter tube is disposed in said gas-tight container and said insulating gas in said gas-tight container has a pressure of at least 2 bar.

8. The switchgear assembly as claimed in claim 7, wherein said insulating gas in said gas-tight container has a pressure of at least 3 bar.

9. The switchgear assembly according to claim 7, wherein said insulating gas contains at least one fluoroketones, nitriles, nitrogen, oxygen and carbon dioxide.

* * * * *